United States Patent [19]

Bedel

[11] 4,191,874

[45] Mar. 4, 1980

[54] MANUALLY OPERABLE SWITCH

[75] Inventor: Denis E. Bedel, Ross, Pa.

[73] Assignee: Westinghouse Electric Corp., Pittsburgh, Pa.

[21] Appl. No.: 941,611

[22] Filed: Sep. 12, 1978

[51] Int. Cl.[2] ..... H01H 3/02

[52] U.S. Cl. ..... 200/339; 116/279; 200/308

[58] Field of Search ..... 200/339, 308, 329, 67 DA, 200/153 LB; 74/477, 483 PB, 473 R; 116/279, 307

[56] References Cited

U.S. PATENT DOCUMENTS

| | | | |
|---|---|---|---|
| 3,217,112 | 11/1965 | Campbell et al. | 200/339 X |
| 3,381,104 | 4/1968 | Abell et al. | 200/339 X |
| 4,121,071 | 10/1978 | Campbell et al. | 200/339 X |

*Primary Examiner*—Frederick R. Schmidt
*Attorney, Agent, or Firm*—D. R. Lackey

[57] ABSTRACT

A manually operable switch wherein at least the externally accessible portion of a pivotally mounted actuator member has a spheroidal configuration. An indentation in the spheroidal configuration enables the actuator member to be operated between predetermined angular positions.

2 Claims, 7 Drawing Figures

MANUALLY OPERABLE SWITCH

BACKGROUND OF THE INVENTION

1. Field of the Invention

The invention relates to manually operable electrical switches.

2. Description of the Prior Art

An emergency stop switch is required in elevator cars, which when operated causes electric power to be removed from the elevator drive motor and brake of a traction elevator, or from the electrically operated valves and/or pump motor of a hydraulic elevator. Co-pending application Ser. No. 941,617, filed Sept. 12, 1978, in the name of F. E. Coyle, entitled "Push Buttom Assembly", which is commonly assigned, discloses a new and improved push button assembly which has many advantages for use as an elevator car call button in the car-mounted call station. The housing of this new and improved push button assembly is strong mechanically and is designed to take abuse, both accidental and intentional, as well as to present a pleasing appearance. Further, this new and improved push button has raised legends immediately to the user's left of the actuating plunger of the push button assembly, in order to aid the visually handicapped.

The emergency stop switch is normally mounted on the same control panel as the car call push buttons, and it would be desirable to provide an emergency stop switch which may be mounted in the same space as the new and improved push button assembly, as well as to be compatible with the physical locations of the identifying legends and actuating members of the new and improved push button assembly, in order to aid the visually handicapped.

In the prior art, the operating toggle of the emergency stop switch is normally in the form of a handle or lever, to distinguish it from the car call push bottons which have a depressible actuating member, and it is usually formed of a red material in order to additionally signify its emergency nature. It would be desirable to provide a new and improved emergency stop switch which further emphasizes its emergency nature, and which reduces the possibility of accidental tripping by the sighted, such as by catching the operating or actuating member on clothing, a briefcase, or the like, and which also reduces the possibility of accidental tripping by the visually handicapped as they touch the control panel to locate and detect the legends which identify the car call push buttons.

SUMMARY OF THE INVENTION

Briefly, the present invention is a new and improved manually operable switch which includes a pivotally mounted actuator member and an electrical contact assembly. At least the accessible portion of the actuator member is spheroidal in configuration, with an identation in the spheroidal surface enabling the actuating member to be moved between first and second angular positions which operate the associated electrical contact assembly to first and second positons, respectively. The indentation is formed by first and second substantially flat surfaces which intersect to define a predetermined angle between them. This predetermined angle is related to the travel angle of the actuator between its two angular positions, and is preferably equal to 180° minus the travel angle. This relationship enables the first substantially flat surface of the indentation to be vertically oriented in the first angular position of the actuator member, and the second substantially flat surface of the indentation to be vertically oriented in the second angular position of the actuator member. The first and second substantially flat surfaces intersect the surface of the spheroidal configuration within a single quadrant, measured about the pivot axis of the actuator, with the areas of the first and second substantially flat surfaces being selected, and with the actuator being oriented such that in the first angular position the intersection of the first and second flat surfaces both occur above the pivot axis. The relative areas of the first and second flat surfaces, the locations of the flat surfaces relative to the pivot axis, and the spheroidal configuration, all cooperate to make accidental actuation of the actuator member from its first to its second position highly improbable.

BRIEF DESCRIPTION OF THE DRAWINGS

The invention may be better understood and further advantages and uses thereof more readily apparent, when considered in view of the following detailed description of exemplary embodiments, taken with the accompanying drawings in which.

DESCRIPTION OF PREFERRED EMBODIMENT

Figure 1:
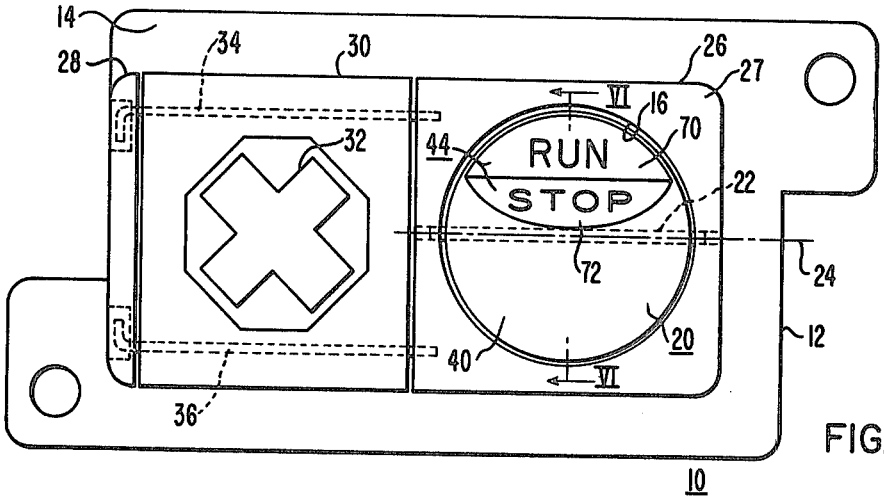
FIG. 1 is an elevational view of a switch assembly which is constructed according to the teachings of the invention, with the switch actuator member being shown in a first angular position.

Referring now to the drawings, and to FIG. 1 in particular, there is shown a switch assembly 10 constructed according to the teachings of the invention. Switch assembly 10 includes a housing 12 having a front portion 14, a cylindrical recess 16 which starts at the front portion 14 and extends into a cavity defined by the housing 12, and an actuator member 20. Actuator member 20 is pivotally mounted in the cylindrical recess 16 via a pivot pin 22 which is coaxial with a horizontal pivot axis 24.

For purposes of example, housing 12 is illustrated as being similar to the push button housing shown in the hereinbefore referred to commonly assigned application Ser. No. 941617 filed Sept. 12, 1978, and this application is hereby incorporated into the present application by reference in order to illustrate housing details which may be used to construct switch assembly 10. However, it is to be understood that the present invention applies to any manually operable switch assembly having a pivotally mounted actuator member.

As described in detail in the incorporated application, the front portion 14 of housing 12 may include a first projection 26 having a front surface 27 which surrounds the front opening to recess 16, a second projection 28 which is horizontally spaced from the first projection 26, and a legend block 30 disposed in the space between the two projections, to the left of the actuator member 20, as viewed in FIG. 1. The legend block 30 includes a raised portion 32 which signifies to the sighted and to the visually handicapped the function of the switch assembly 10. The "X" illustrated indicates that the switch assembly 10 is the emergency stop switch for use in an elevator car, but the switch assembly is not limited to this application.

As described in detail in the incorporated application, the legend block 30 may be "pinned" into the assembled position via pin members 34 and 36, each of which enter aligned openings in projection 28, legend block 30, and projection 26.

Figure 2:
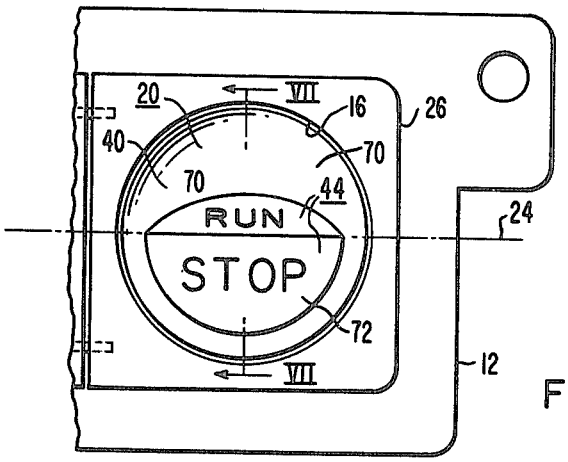
FIG. 2 is a fragmentary view of the switch assembly shown in FIG. 1, illustrating the switch actuator member in a second angular position.

Actuator member 20 includes a first portion 40 accessible from the front side of housing 12, and a second portion 42, best shown in FIGS. 3 through 7, with the second portion being within the cavity of the housing 12. At least the first portion 40 is spherical in configuration, with an indentation 44 being formed in the spherical configuration to enable the actuator member 20 to be manually actuated between a first angular position shown in FIG. 1, and a second angular position shown in FIG. 2. FIG. 2 is a fragmentary view of switch assembly 10, similar to that of FIG. 1, except for the position of the actuator member 20.

Figure 5:
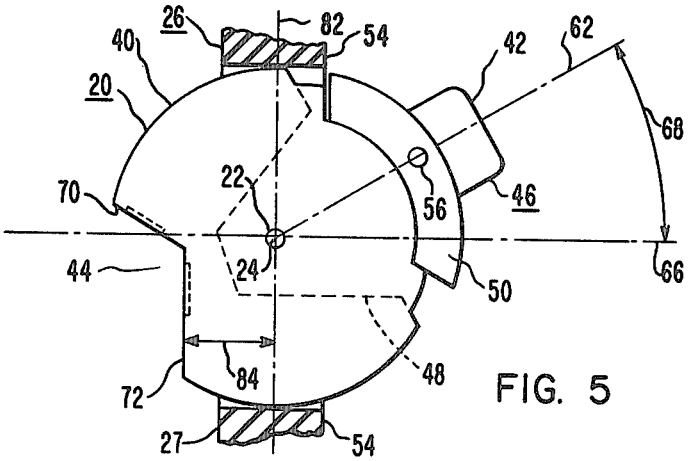
FIG. 5 is a side-elevational view of the actuator member, with the actuator member being illustrated in the angular position shown in FIG. 2.
Figure 3:
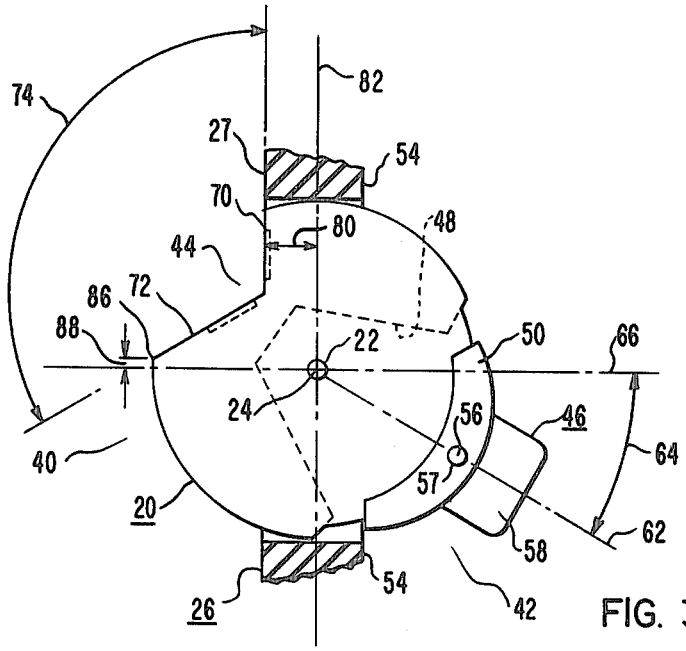
FIG. 3 is a side-elevational view of the actuator member, illustrated in the first angular position of FIG. 1, setting forth certain preferred relationships between the travel angle, and the indentation which enables the actuator member to be operated between its angular positions.
Figure 4:
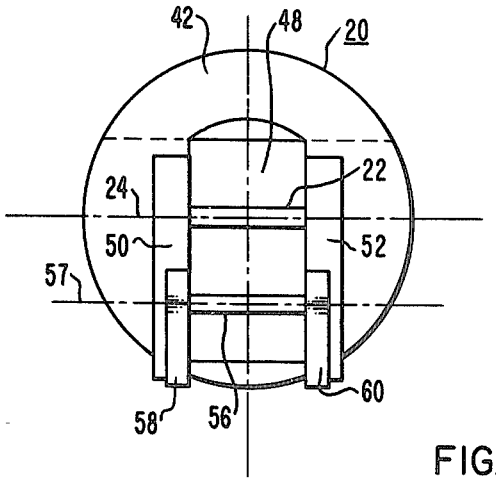
FIG. 4 is a rear-elevational view of the actuator member shown in FIG. 3.

FIG. 3 is a side-elevational view of actuator member 20, in the angular position shown in FIG. 1, FIG. 4 is a rear-elevational view of actuator member 20, as illustrated in FIG. 3, and FIG. 5 is a side-elevational view of actuator member 20, illustrated in the angular position shown in FIG. 2. In the preferred embodiment of the invention illustrated in FIGS. 3, 4 and 5, the second portion 42 of the actuator member 20 continues the spherical configuration of the first portion 40, with actuator means 46 being added to the spherical configuration for cooperating with the specific electrical contact assembly or switch mechanism utilized. The continued spherical configuration has many advantages, including providing the necessary operating clearance for actuator member 20 to pivot within the cylindrical recess 16.

Actuator member 20 has an opening 48 accessible from the second portion 42 thereof, with the pivot pin extending between the sides of the actuator member which define this opening. As illustrated in the Figures, the pivot axis 24 preferably intersects the center of the spherical configuration.

First and second stop members 50 and 52 are horizontally spaced on opposite sides of opening 48, with the stop members 50 and 52 extending outside the cylindrical configuration of the recess 16, as best shown in FIG. 4, to contact an inner wall 54 of the front portion 14 in both angular positions of actuator member 20, in order to establish the travel limits of the actuator member 20.

An actuator pin 56 is provided which extends between the spaced stop members 50 and 52, with the actuator pin 56 being coaxial with a horizontal axis 57. Actuator pin 56 cooperates with the operating mechanism of the electrical contact assembly or switch mechanism, as will be hereinafter explained relative to FIGS. 6 and 7.

Figure 6:
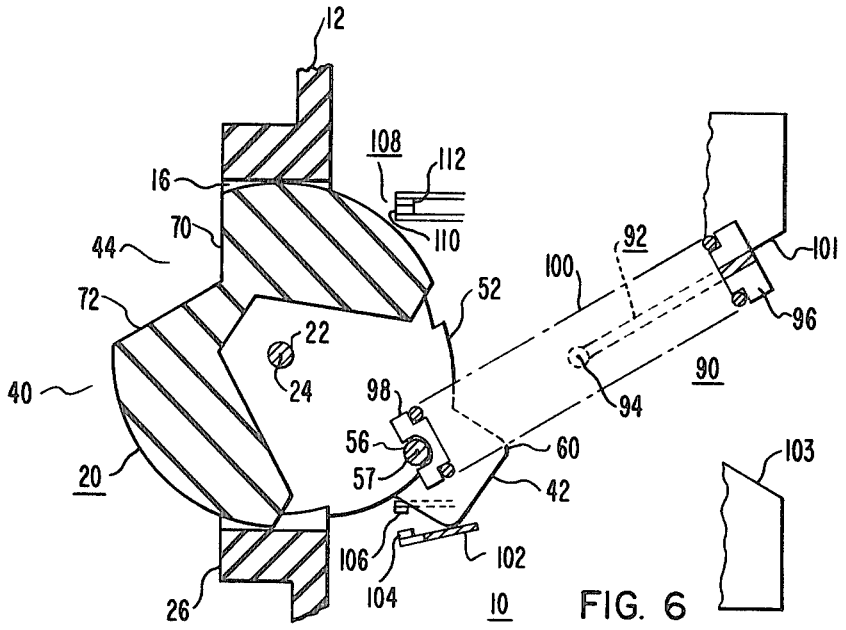
FIG. 6 is a cross-sectional view of the switch assembly shown in FIG. 1, taken between and in the direction of arrows VI—VI, with only the operative parts of the switch assembly being illustrated.
Figure 7:
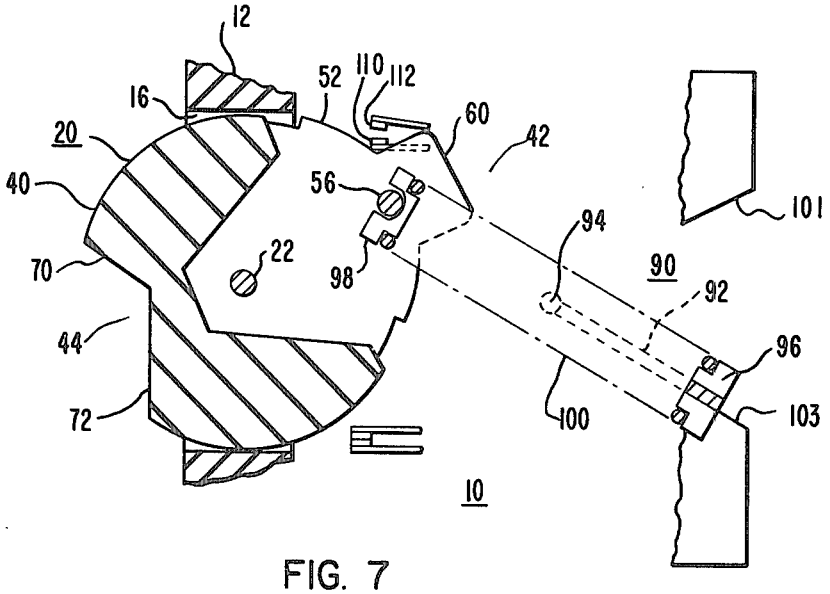
FIG. 7 is a cross-sectional view of the switch assembly shown in FIG. 2, taken between and in the direction of arrows VII—VII, with only the operative parts of the assembly being illustrated.

First and second electrical contact actuator members 58 and 60 extend outwardly from the first and second horizontally spaced stop members 50 and 52, respectively, whose purpose will also be explained relative to FIGS. 6 and 7.

The indentation 44 has a configuration related to the travel angle of the actuator member 20. As illustrated in FIGS. 3 and 5, the travel angle is the angle between the two positions of a center line 62 which intersects axes 24 and 57, and it includes the angle 64 between center line 62 and horizontal line 66 in FIG. 3, and the angle 68 between center line 62 and horizontal line 66 in FIG. 5. For purposes of example, angles 64 and 68 are selected to each be approximately 30°, and thus the travel angle of actuator member 20 is approximately 60°.

The indentation 44 includes first and second substantially flat surfaces 70 and 72 which extend inwardly from the spherical surface of the first portion 40 and intersect one another, with the intersecting planes of the surfaces forming an angle 74 which is equal to 180° minus the travel angle. Thus, in the example given wherein the travel angle is approximately 60°, the angle 74 between the intersecting surfaces 70 and 72 of the spherical actuator ball is 120°. The locations of surfaces 70 and 72 are selected such that they have different areas. The location of surfaces 70 and 72 are also selected such that the intersections of the flat surfaces with the outer surface of the spherical configuration occur at preselected positions in the first angular position of the actuator member 20 shown in FIGS. 1 and 3, and also in the second angular position of actuator member 20 shown in FIGS. 2 and 5. The criteria for their location include the following requirements: (1) the first surface 70 should be perpendicularly oriented in the first angular position of actuator member 20, and the second surface 72 should be perpendicularly oriented in the second angular position of actuator member 20, (2) the intersection of both surfaces 70 and 72 with the surface of the spherical configuration should occur within a single 90° arc or quadrant, measured about the pivot axis 24, (3) The intersection of both surfaces 70 and 72 with the surface of the spherical configuration should occur above the pivot axis 24 when the actuator member 20 is in the first angular position shown in FIGS. 1 and 3, and (4) the area of surface 72 fortripping the switch assembly from the first angular position of the actuator member 20 to the second angular position, should exceed the area of the surface 70 for tripping the actuator member 20 from the second angular position to the first angular position.

Requirement (1) directs the manual actuating pressure to the proper surface, and it completes the travel angle without either surface extending back into the recess 16. It also enables a legend displayed on either or both surfaces to be most clearly displayed when the switch is in the position associated with the perpendicularly oriented surface. For example, as illustrated in FIG. 1, when the switch assembly 10 is used as an emergency stop switch, a legend "STOP" may be engraved in the second surface 72. The legend "RUN" may be engraved in the first surface 70. It will be noted that the position of the switch assembly 10 is automatically noted by the relative sizes of the perpendicular dimensions of the two legends. If a legend is applied to only one surface, the angle of the surface will still display the legend such that it will indicate the switch position. Forming the angle 74 to be equal to 180° minus the travel angle enables this requirement to be achieved.

Requirement (2) preserves a large portion of the spherical surface of the first portion, while providing adequate surface areas for operating the actuator member 20. The larger sherical surface deflects accidental forces applied to the actuator member 20.

Requirement (3) makes it impossible for a force applied to the actuator member in a direction perpendicular to the front 14 of the housing 12, from tripping the actuator member 20 from the first angular position shown in FIGS. 1 and 3 to the second angular position shown in FIGS. 2 and 5. When used as an emergency stop switch in an elevator car, the first angular position is the "RUN" position, and the second angular position is the "STOP" position, and accidental stopping of the elevator car is to be avoided.

Requirement (4) provides a relatively large surface for tripping the actuator member 20 from the first to the second angular positions, when an emergency arises and such actuation is intended.

Requirements (2), (3) and (4) are provided by forming the first surface 70 such that its spacing 80 from a vertical center line 82 shown in FIG. 3 is smaller than the spacing 84 between the second surface 72 and vertical center line 82 shown in FIG. 5.

It will be noted that in the first angular position shown in FIG. 3, that the lowest edge 86 of surface 72 is shown as being above center line 66 by a predetermined small dimension 88, which is preferred, but it would also be suitable if edge 86 is located as low as center line 66.

It should also be noted that when the first surface 70 is perpendicularly oriented, that it is substantially flush with the forward surface 27 of projection 26, and when surface 72 is perpendicularly oriented, that it is spaced outwardly from surface 27. This arrangement further adds to the difficulty of accidentally tripping switch 10 from the first angular position shown in FIG. 3 to second angular position shown in FIG. 5.

FIG. 6 is a cross-sectional view of switch assembly 10 shown in FIG. 1, taken between and in the direction of arrows VI—VI, and FIG. 7 is a cross-sectional view of switch assembly 10 shown in FIG. 2, taken between and in the direction of arrows VII—VII. FIGS. 6 and 7 illustrate actuator member 20 operatively coupled with an electrical contact assembly or switch mechanism 90 which may be used. Switch mechanism 90 is shown merely for purposes of example, however, as many different operating mechanisms may be used. Operating mechanism 90, in this example, is an over-center toggle mechanism which includes a U-shaped frame member 92, with the ends of the leg portions thereof being pivotally mounted on a common horizontal pivot axis 94. The bight portion of the U-shaped frame member 92 carries a first spring seat 96. A second spring seat 98 rides on the actuator pin 56, and a spiral spring member 100 extends between spring seats 96 and 98. Spiral spring 100 is compressed slightly, which biases or holds the second spring seat 98 against the actuator pin 56. Stops 101 and 103 limit the travel of the U-shaped frame member 92.

In the first angular position of the actuator member 20, shown in FIG. 6, contact actuator member 58 and 60 each apply pressure to a common electrically conductive bridging member 102, to overcome a normally upward bias and bend it in a downward direction. Thus, electrical contacts on the bridging member 102, such as contact 104, may be separated from an associated stationary contact, such as stationary contact 106. The conditions of additional pairs of contacts, such as contact pair 108 which includes a stationary contact 110 and a movable contact 112, are unaltered in this position, and may be normally closed, as illustrated.

When the second surface 72 is depressed in a downward direction, spring 100 will operate the U-shaped frame 92 from the position shown in FIG. 6, where it is resting against stop 101, to the position shown in FIG. 7, where it is resting against stop 103, with the spring action continuing the pivoting of the actuator member 20 once it reaches a predetermined angular position, to snap the two stop members of the actuator member 20 against their associated stops formed by the back wall 54 of the front portion 14 of the housing. The actuator members 58 and 60 will thus be removed from the bridging member 102, with the spring bias in this member returning the contacts associated therewith into engagement with their stationary contacts. The actuator members 58 and 60 will now apply pressure to a bridging member which carries the movable contacts of the additional sets of contacts, such as movable contact 112 of set 108, to separate it from its associated stationary contact 110. Upward pressure on surface 70 sufficient to rotate actuator member 20 about its axis 24 by a predetermined angle will snap the switch assembly back to the position shown in FIG. 6.

I claim as my invention:

1. A switch which facilitates actuation by choice in a preferred direction, while minimizing accidental actuation in this direction, comprising:

a housing having a substantially flat, vertically oriented, front surface, an electrical contact assembly mounted in said housing, said electrical contact assembly being operable between first and second positions, and an actuator member pivotally mounted in said housing on a horizontally oriented pivot axis, said actuator member having a first portion accessible from the outside of said housing, and a second portion within the housing operatively linked with said electrical contact assembly, said first portion having a generally spheroidal configuration, with an indentation therein for pivotally operating said actuator member between first and second angular positions which select the first and second positions, respectively, of said electrical contact assembly, said indentation in the first portion of the actuator member including first and second substantially flat, intersecting surfaces for operating the actuator member to its first and second positions, respectively, with their planes having predetermined different spacings from the horizontally oriented pivot axis selected to cause the area of the second substantially flat surface to exceed the area of the first substantially flat surface, facilitating actuation by choice to its second position, said first and second flat surfaces being oriented relative to one another, and to the pivot axis of the generally spheroidal configuration, such that the flat first surface of the indentation is in substantially the same plane as the front surface of the housing, and the lowest edge of the second substantially flat surface lies above the pivot axis, when the actuator member is in the first angular position, to minimize accidental operation of the actuator member to its second position and to preclude a force applied to the actuator member in a direction perpendicular to the front surface of the housing from operating the actuator member to its second condition.

2. The switch of claim 1 wherein the plane of the substantially flat second surface of the indentation is spaced outwardly from the plane of the front surface of the housing which surrounds the actuator member, when the actuator member is in the second angular position.

* * * * *